US011237581B2

(12) United States Patent
Shankar et al.

(10) Patent No.: US 11,237,581 B2
(45) Date of Patent: Feb. 1, 2022

(54) LOW-DROPOUT (LDO) VOLTAGE SYSTEM

(71) Applicant: TEXAS INSTRUMENTS INCORPORATED, Dallas, TX (US)

(72) Inventors: Niranjan Shankar, Chennai (IN); Sreeram Subramanyam Nasum, Bengaluru (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 16/727,586

(22) Filed: Dec. 26, 2019

(65) Prior Publication Data

US 2020/0333815 A1 Oct. 22, 2020

(30) Foreign Application Priority Data

Apr. 20, 2019 (IN) ..... 201941015764

(51) Int. Cl.
*G05F 1/56* (2006.01)

(52) U.S. Cl.
CPC ..... *G05F 1/56* (2013.01)

(58) Field of Classification Search
CPC ... G05F 1/10; G05F 1/46; G05F 1/462; G05F 1/465; G05F 1/56; G05F 1/561; G05F 1/618; G05F 3/247; G05F 3/26; G05F 3/262
See application file for complete search history.

(56) References Cited

U.S. PATENT DOCUMENTS 10,530,249 B1 * 1/2020 Lee ..... G01R 19/16528
2011/0156670 A1 * 6/2011 Tadeparthy ..... G05F 1/56 323/273
2015/0309518 A1 * 10/2015 Nagda ..... H02M 3/07 323/274
2018/0351450 A1 * 12/2018 Pelicia ..... H02M 3/07

* cited by examiner

*Primary Examiner* — Alex Torres-Rivera
(74) *Attorney, Agent, or Firm* — John R. Pessetto; Charles A. Brill; Frank D. Cimino

(57) ABSTRACT

A low-dropout voltage system comprising a current supply with a transistor circuitry, a mode switch capacitor, and a decoupling capacitor, wherein the mode switch capacitor facilitates the low-drop voltage system to swiftly transition from a low mode with a minimal to no transient current output to a high mode with a transient current of about 6 mA by dynamically biasing the transistor circuitry while limiting a voltage or current draw from an external power source.

13 Claims, 5 Drawing Sheets

LOW-DROPOUT (LDO) VOLTAGE SYSTEM

RELATED APPLICATIONS

This application claims priority to Indian Provisional Application No. 201941015764, filed on Apr. 20, 2019, which is hereby incorporated by reference.

BACKGROUND

A low-dropout (LDO) voltage system regulates its voltage output to provide a consistent power drive to a load coupled to the LDO voltage system. Where voltage input varies, the LDO voltage system can provide a consistent voltage output that is minimally lower than the lowest of the varying voltage input. For instance, where the input voltage ranges from 2.2 V to 2.5 V, the LDO voltage system outputs a consistent voltage of 1.8 V.

A digital isolator provides isolation between circuits communicating with each other. Many electronic circuits include integrated circuits that operate using power supplies having a group voltage that is different from the ground voltage of other integrated circuits. The direct current (DC) isolation between communicating circuits is desirable to protect the components of each circuits, shift signal levels, adhere to safety regulations, etc.

The communication between the two isolated sides coupled through a digital isolator is accomplished using high-frequency modulated signals. When a digital isolator is coupled to the LDO voltage system as a load, the LDO voltage system drives a transceiver that generates the high-frequency modulated signals. To reduce the power consumption during the operation of the digital isolator, there is a need for a LDO voltage system that outputs varying size of load current to the transceiver that syncs with the generation of the high-frequency modulated signals.

SUMMARY

According to an aspect of the present invention, a LDO voltage system with at least two operational mode is provided, wherein the at least two operational mode comprises a low mode that provides a low current to its load and a high mode that provides a high current to its load. In one example, the LDO voltage system operates in the high mode where a transceiver of a digital isolator generates a high-frequency modulated signal.

According to another aspect of the present invention, a LDO voltage system enters into a boost mode to transition from a low mode to a high mode to prepare for the generation of the high-frequency modulated signal by the transceiver.

According to another aspect of the present invention, a LDO voltage system enters into a boost mode or a high mode by adjusting a bias current of a MOSFET circuitry, where the MOSFET circuitry outputs a current forwarded to a load of the LDO voltage system as a load current. In one example, the bias current of the MOSFET circuitry is increased so that the LDO voltage system enters a boost mode or a high mode. The bias current of the MOSFET circuitry may be increased by opening and closing a switch connecting the transistors of the MOSFET circuitry.

BRIEF DESCRIPTION OF THE DRAWINGS

For a detailed description of various examples, reference will now be made to the accompanying drawings in which.

DETAILED DESCRIPTION

In this description, the term "couple" or "couples" means either an indirect or direct wired or wireless connection. Thus, if a first device couples to a second device, that connection may be through a direct connection or through an indirect connection via other devices and connections. The recitation "based on" means "based at least in part on." Therefore, if X is based on Y, X may be a function of Y and any number of other factors.

Figure 1:
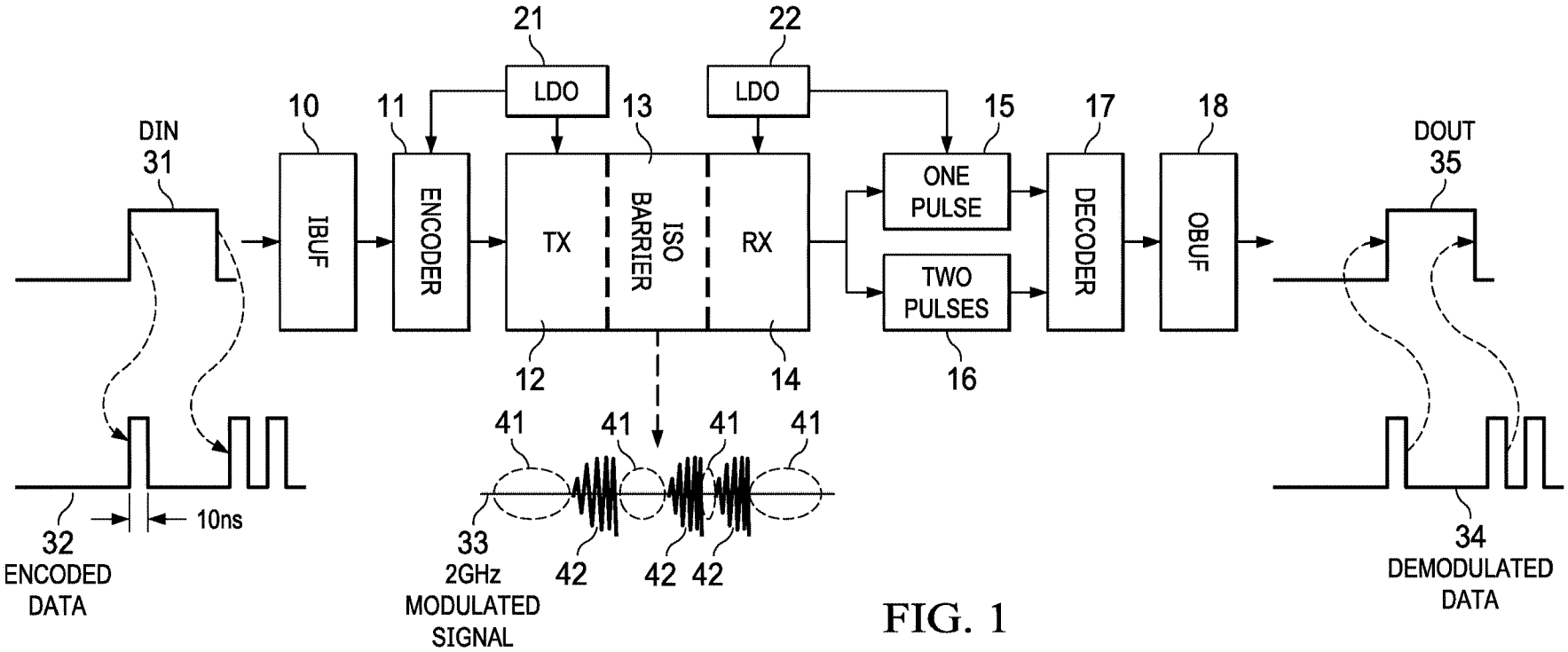
FIG. 1 illustrates a LDO voltage system coupled to an isolator according to an aspect of the present invention.

FIG. 1 illustrates a LDO voltage system coupled to an isolator according to an aspect of the present invention. In FIG. 1, LDO voltage system 21 and LDO voltage system 22 are each coupled to an isolator. The isolator of FIG. 1 comprises input buffer (IBUF) 10, encoder 11, transceiver (TX) 12, isolation barrier 13, receiver (RX) 14, one pulse detector 15, two pulse detector 16, decoder 17, and output buffer (OBUF) 18. Input data (DIN) 31 is transmitted through the isolator of FIG. 1 and generated as output data (DOUT) 35.

Input buffer 10 temporarily stores input data 31 provided to the isolator, and encoder 11, coupled to input buffer 10, generates encoded data 32 representing input data 31. As illustrated, encoded data 32 represents a rising edge of input data 31 by a single pulse of 10 ns and a falling edge of input data 31 by two consecutive pulses. Encoder 11 is driven by LDO voltage system 21.

Transceiver 12, coupled to encoder 11 and driven by LDO voltage system 21, generates a high-frequency modulated signal based on pulse signal 32. In the example of FIG. 1, OOK modulated signal 33, which represents encoded 32, is generated by transceiver 12. Modulated signal 33 is of 2 GHz and drives isolation barrier 13.

Isolation barrier 13 comprises a capacitor. Receiver 14, coupled to isolation barrier 13 and driven by LDO voltage system 22, generates demodulated data 34 based on the operation of isolation barrier 13 driven by modulated signal 33. Demodulated data 34 is fed into one pulse detector 15 and two pulse detector 16. Decoder 17, coupled to one pulse detector 15 and two pulse detector 16, decodes demodulated data 34, which is temporarily stored in output buffer 18 before output as output data 35. One pulse detector 15 and two pulse detector 16 are each driven by LDO voltage system 22.

Transceiver 12 generates modulated signal 33 that represents encoded data 32. LDO voltage system 21 provides a regular load current to transceiver 12 during the period where encoded data 32 value is low. Flat portions 41 of modulated signal 33 correspond to and represent the period during which encoded data 32 value is low. LDO voltage system 21 provides a higher load current to transceiver 12 during the period where encoded data 32 value is high. Non-flat portions 42 of modulated signal 33 correspond to and represent the period during which encoded data 32 value is high.

Figure 2:
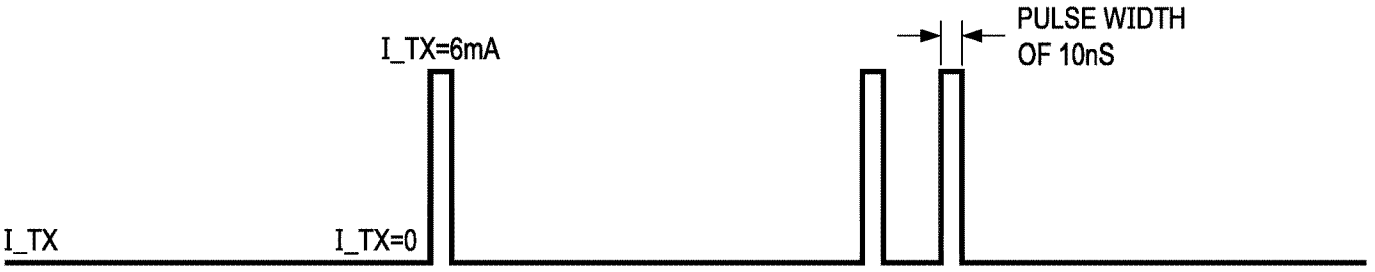
FIG. 2 illustrates a current profile of a transceiver of the isolator of FIG. 1.

In one example, LDO voltage system 21 is configured to regulate the load current output to transceiver 12 based on encoded data 32 output of encoder 11. FIG. 2 illustrates a current profile of a transceiver of the isolator of FIG. 1, i.e., transceiver 12. As illustrated in FIG. 2, to generate non-flat portions 42 of modulated signal 33, transceiver 12 requires a higher current (I_TX) of 6 mA for 10 ns. LDO voltage system 21 supplies the 6 mA of transient current to transceiver 12 when encoded data 32 value is high.

In an example according to an aspect of the present invention, LDO voltage system 21 provides the 6 mA of transient current without increasing, or increasing only minimally, bias current or bias voltage of LDO voltage system 21 to suppress and regulate power consumption during the output of transient current. In other words, LDO voltage system 21 is configured to generate a higher current output to transceiver 12, when encoded data 32 value is high, by reconfiguring the interconnects of its circuit components while maintaining its power consumption at a minimum.

In an example according to an aspect of the present invention, LDO voltage system 21 is configured to operate in a low mode where encoded data 32 value is low. The value of transient current output from LDO voltage system 21 to transceiver 21 when LDO system voltage system 21 is in a low mode is about 0 mA. LDO voltage system 21 is further configured to operate in a high mode where encoded data 32 value is high. The value of transient current output from LDO voltage current system 21 to transceiver 12 when LDO voltage system 21 is in a high mode is about 6 mA.

In an example according to an aspect of the present invention, LDO voltage system 21 enters a boost mode before or when the value of encoded data 32 transitions from low to high. Boost mode conditions LDO voltage system 21 to enter a high mode when encoded data 32 value is about to transition from low to high. LDO voltage system 21 may enter the boost mode within a preset time before encoded data 32 value transitions from low to high. In one example, the present time may be a range of time from 5 to 10 ns.

In an example according to an aspect of the present invention, LDO voltage system 21 enters a fast release mode when a preset time lapses after encoded data 32 value has transitions from low to high. In one example, LDO voltage system 21 enters the fast release mode about 10 ns after the transition from low to high occurred. In another example, LDO voltage system 21 enters the fast release mode when encoded data 32 value transitions from high to low. Fast release mode conditions LDO voltage system 21 to return to a low mode quickly.

In one example, same or largely consistent bias current or bias voltage is applied to LDO voltage system 21 during the different modes. In other words, despite the transitions between a low mode, a high mode, a boost mode, and a fast release mode, the external power drive may be configured to supply the same or only slightly varying bias current or bias voltage to LDO voltage system 21. LDO voltage system 21 is configured to reconfigure the interconnects of its circuit components to output 0 or 6 mA of current to transceiver 12 so that transceiver 12 generates modulated signal 33 corresponding to encoded data 32.

Details related to the examples of the present invention is provided further in relation to FIGS. 3-6.

Figure 3:
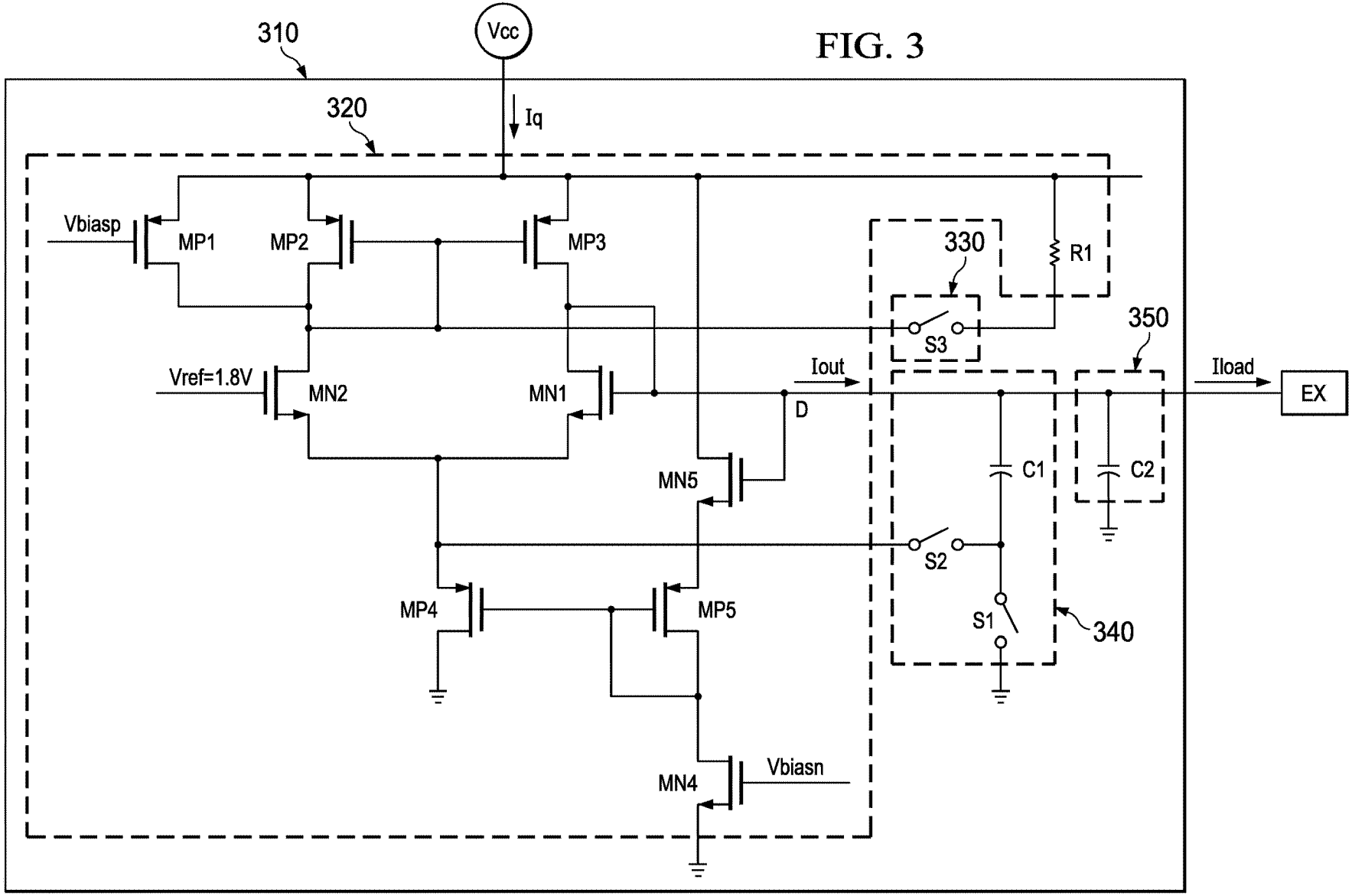
FIG. 3 illustrates a block diagram of the LDO voltage system of FIG. 1 according to an aspect of the present invention.

FIG. 3 illustrates an exemplary block diagram of the LDO voltage system of FIG. 1 according to an aspect of the present invention. In the example of FIG. 3, LDO voltage system 310 is coupled to voltage source Vcc, providing source current Iq to LDO voltage system 310. LDO voltage system 310 is also coupled to external load EX, such as transceiver 12 of FIG. 1.

Depending on the value of output signal of encoder 11 of FIG. 1, LDO voltage system 310 operates in one of low mode, boost mode, high mode, and fast switch mode. LDO voltage system 310 in a low mode provides a transient current of about 0 mA to external load EX as part of load current Iload. LDO voltage system 310 in a high mode provides a transient current of about 6 mA to external load TX as part of load current Iload. LDO voltage system 310 transitions from the low mode to the high mode or transitions from the high mode to low mode.

For efficient transitions, LDO voltage system 310 enters a boost mode when it transitions from the low mode to the high mode. In the boost mode, LDO voltage system 310 is conditioned to quickly increase load current Iload. Similarly, LDO voltage system 310 enters a fast switch mode when it transitions from the high mode to the low mode. In the fast switch mode, LDO voltage system 310 is conditioned to quickly decrease load current Iload.

In one example, external load EX of FIG. 3 comprises transceiver 12 of FIG. 1. Transceiver 12 generates modulated signal 33 based on an encoder 11 output data, encoded data 32. Flat portions 41 of modulated signal 33 represent encoded data 32 with low value. Non-flat portions 42 of modulated signal 33 represent encoded data 32 with high value.

Transceiver 12 assumes more current when it generates non-flat portions 42 of modulated signal 33. As illustrated in FIG. 2, the current profile of transceiver 12 reflects the data values of encoded data 32: transceiver 12 needs at least 6 mA to generate non-flat portions 42 of modulated signal 33. LDO voltage system 310, which operates in a low mode when transceiver 12 is generating flat portions 41 of modulated signal 33, enters a high mode when transceiver 12 generates non-flat portions 42 of modulated signal 33.

Before LDO voltage system 310 enters into the high mode, however, it goes through the boost mode, which conditions LDO voltage system 310 to boost its load current Iload. In one example, LDO voltage system 310 determines when transceiver 12 will be generating non-flat portions 42 based on encoded data 32 of encoder 11. LDO voltage system 310 may make the determination based on the current profile of encoder 11: when encoder 11 generates high value encoded data, it assumes more power from LDO voltage system 310. Based on encoded data 32, LDO voltage system 31 enters a boost mode about 5 to 10 ns before transceiver 12 starts generating non-flat portions 42 of modulated signal 33. Similarly, when encoded data 32 transitions from high to low, LDO voltage system 310 enters fast switch mode to swiftly return to the low mode.

Below table 1 compares the values of source current Iq, load current Iload of LDO voltage system 310, and bandwidth BW when LDO voltage is in a low mode and a high mode.

TABLE 1

| Mode | Low Mode | High Mode |
|---|---|---|
| Source Current Iq | 150 nA | 12 μA |
| Load Current Iload | 10 μA | 6 mA |
| Bandwidth BW | low | high |

As seen in Table 1, load current Iload of LDO voltage system 310 can be increased to 6 mA without significantly increasing source current Iq. Because the FIG. 3 example of LDO voltage system 310 does not require a lot of source current Iq while outputting a higher load current of 6 mA, it reduces energy consumption while driving transceiver 12.

LDO voltage system 310 of FIG. 3 comprises current supply 320, which is coupled to voltage source Vcc and outputs supply current Tout to decoupling capacitor 350. Decoupling capacitor 350 decouples and forwards supply current Tout to external load EX as load current Iload. LDO voltage system 310 further comprises mode changing switch 340 and acceleration switch 330. Mode changing switch 340, which is coupled to a transistor circuitry of current supply 320, adjusts supply current Tout from current supply 320 based on LDO voltage system 310's mode. When external load EX is transceiver 12, LDO voltage system 310's mode depends on the value of encoded data 32. Accordingly, when transceiver 12 is coupled to LDO voltage system 310, mode changing switch 340 adjusts supply current Tout based on the value of encoded data 32.

By adjusting supply current Tout from current supply, mode changing switch 340 changes the mode of LDO voltage system 310 from a low mode to a boost mode to a high mode. Acceleration switch 330 accelerates the transition of LDO voltage system 310 when it transitions from a high mode to a low mode.

Figure 4:
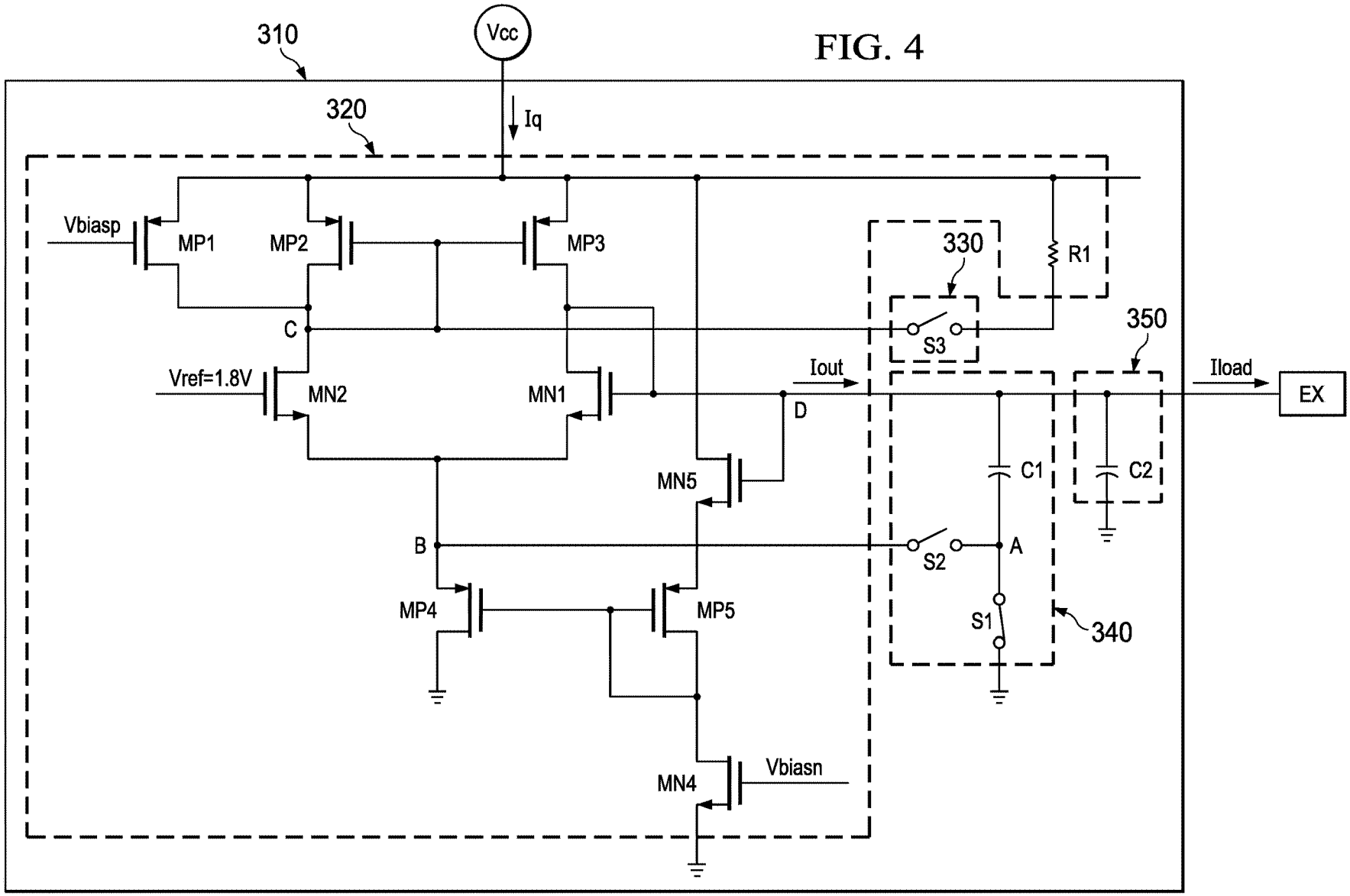
FIGS. 4-6 each illustrates a different configuration of the LDO voltage system of FIG. 1 according to an aspect of the present invention.
Figure 5:
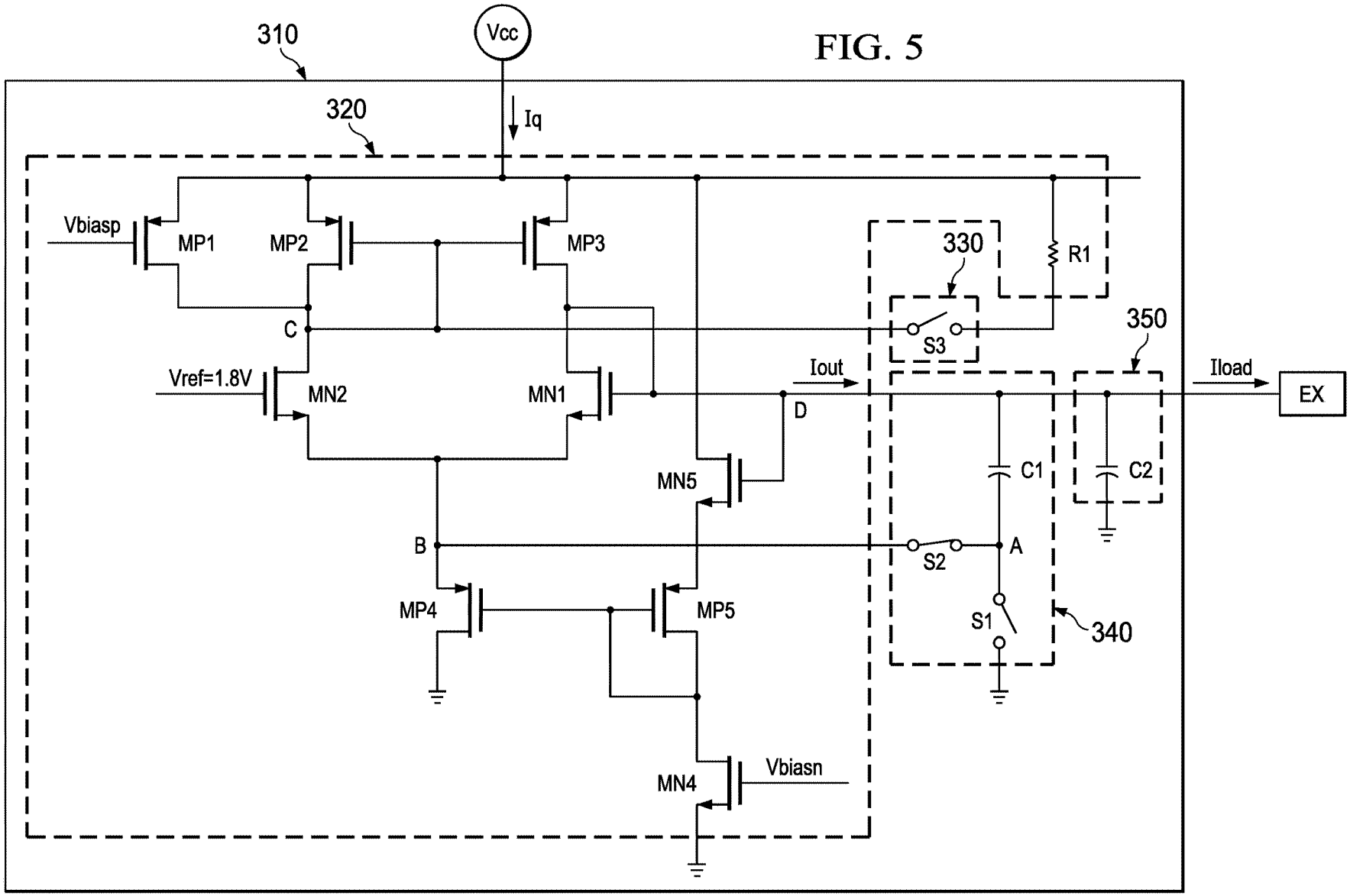
Figure 6:
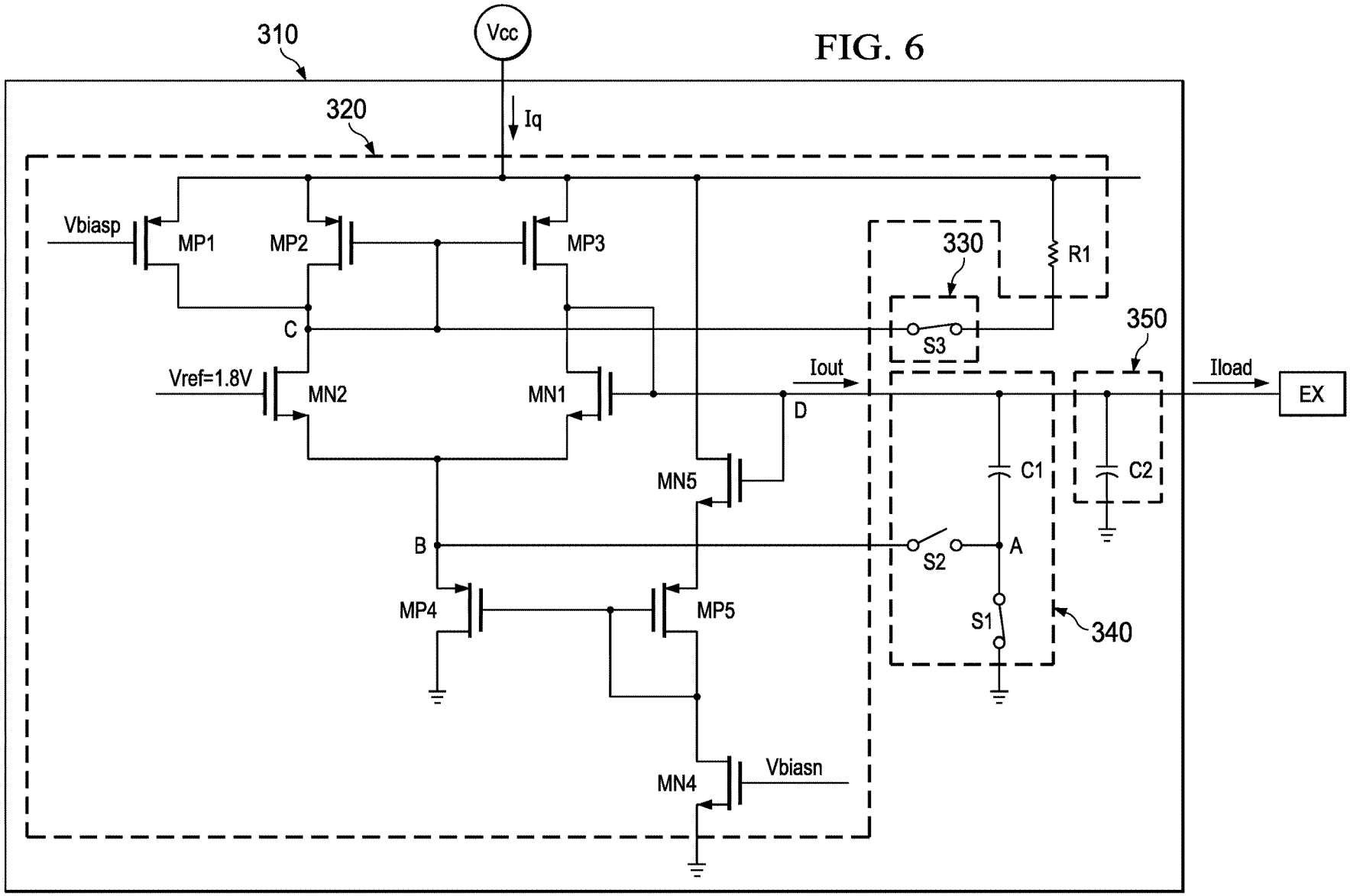

FIGS. 4-6 further illustrate various configurations of mode changing switch 340 and acceleration switch 330 when an exemplary LDO voltage system enters different modes according to various examples of the present invention.

FIG. 4 illustrates an example of LDO voltage system 310 in a low mode. Where external load EX is transceiver 12, LDO voltage system 310 operates in a low mode when encoded data 32 of encoder 11 has a low value.

In FIG. 4, first switch S1 of mode changing switch 340 is closed to couple an end (node A) of mode switch capacitor C1 to a ground. Mode switch capacitor C1 is also coupled to decoupling capacitor 350 (C2) when first switch S1 is closed. Second switch S2 of mode changing switch 340 and acceleration switch 330 (S3) are both open.

Current supply 320 of LDO voltage system 310 comprises a MOSFET current mirror circuitry with transistors MN1~MN5 and MP1~MP5. Bias voltage Vref, Vbiasp, Vbiasn is applied to the respective transistors, and current supply 320 outputs supply current Tout to external load EX. When encoded data 32 value is low, there is little to no transient current in supply current Tout: at most, the transient current in supply current Tout is about 10 μA.

FIG. 5 illustrates an example of LDO voltage system 310 in a boost mode. Where external load EX is transceiver 12, LDO voltage system 310 enters a boost mode about 5 to 10 ns before encoded data 32 value transitions from low to high or when encoded data 32 value transitions from low to high.

In FIG. 5, first switch S1 is opened to release an end of mode switch capacitor C1 from the ground. The released end of mode switch capacitor C1 is coupled to a transistor of the MOSFET current mirror circuitry of current supply 320 via a closed second switch S2 at node B. When the released end of mode switch capacitor C1 is coupled to node B, charge sharing between nodes A and B occurs. This pulls down the voltage of node B, which in turn, pulls down the voltage at the gate of PMOS transistor MP3 as the charges at node C replenishes the decreased charges at node B.

When the voltage at gate of PMOS transistor MP3 is pulled down, higher bias current is applied through PMOS transistor MP3, which leads to a boost in supply current Tout. In one example, the increased boost in supply current Tout is a transient current increasing to reach 6 mA. As LDO voltage system 310 enters a high mode, a transient current of 6 mA of supply current Tout is forwarded to external load TX as load current Iload. When external load is transceiver 12, the transient current continues for about 10 ns.

After the transient current is applied to load current Iload for 10 ns, LDO voltage system 310 returns to a low mode. In another example, LDO voltage system 310 returns to a low mode when encoded data 32 value transitions from high to low.

LDO voltage system 310 enters a fast switch mode, illustrated in FIG. 6, to swiftly return to a low mode. In FIG. 6, acceleration switch 330 is closed to couple the gate of PMOS transistor MP3, at node C, to voltage source Vcc via resistor R1. When voltage source Vcc is coupled to node C, the voltage at gate of PMOS transistor MP3 is pulled up, and the bias current flowing through PMOS transistor MP3 quickly returns to reduce the transient current from supply current Tout.

According to the examples of the present invention, a LDO voltage system with embedded decoupling capacitor (e.g., decoupling capacitor 350) can swiftly enter a high mode and return to a low mode to drive a transceiver according to the high and low values of encoded data. Further, the LDO voltage system's consumption of energy is limited when it enters a high mode because the LDO voltage system provides a transient current by simply adjusting the configuration of its transistors. In other words, the LDO voltage system according to the present invention does not rely solely on the external power source to generate a transient current to forward as a load current.

According to the examples of the present invention, a LDO voltage system can meet the ultra-low power consumption quiescent current consumption requirements. Also, it enables an on load demand bandwidth increase of a LDO voltage system with a preset mode change, and on load demand transient response from the LDO voltage system.

Modifications are possible in the described embodiments, and other embodiments are possible, within the scope of the claims.

What is claimed is:

1. A low-dropout voltage system comprising:

a current supply;

a decoupling capacitor coupled to the current supply; and a mode changing switch coupled to the current supply;

wherein, the current supply comprises a transistor circuitry configured to output a supply current;

the decoupling capacitor is configured to decouple and forward the supply current to an external load as a load current;

the mode changing switch is configured to adjust the supply current output of the current supply by adjusting a bias current of the transistor circuitry; and the load current is configured to be adjusted based on the adjustment of the supply current;

wherein, the low-dropout voltage system is coupled to an encoder, and the mode changing switch is configured to adjust the bias current of the transistor circuitry based on a signal output of the encoder;

wherein, the mode changing switch is configured to increase the bias current of the transistor circuitry when the signal output of the encoder transitions from low to high, and the supply current is configured to increase when the mode changing switch increases the bias current of the transistor circuitry.

2. The low-dropout voltage system of claim 1, wherein, the mode changing switch is configured to maintain the increased bias current of the transistor circuitry when the signal output from the encoder remains high.

3. The low-dropout voltage system of claim 1, wherein the mode changing switch comprises, a mode switch capacitor, a first end of which is coupled to the decoupling capacitor;

a first switch coupled to a second end of the mode switch capacitor and a ground; and a second switch coupled to the second end of the mode switch capacitor and the transistor circuitry, wherein the first switch is configured to be open and the second switch is configured to be closed when the signal output from the encoder transitions from low to high, the mode switch capacitor is configured to pull down a voltage of a source of a PMOS transistor of the transistor circuitry to increase the bias current of the PMOS transistor when the first switch opens to decouple the second end of the mode switch capacitor from the ground and the second switch closes to couple the second end of the mode switch capacitor to the source of the PMOS transistor, and wherein the PMOS transistor is configured to output a higher current to the first end of the mode switch capacitor when the PMOS transistor's source voltage is pulled down and increase the supply current of the current supply.

4. The low-dropout voltage system of claim 3, wherein, the first switch is configured to transition from a close to an open state, and the second switch is configured to transition from an open to a close state within a preset time range when the signal output from the encoder transitions from low to high.

5. The low-dropout voltage system of claim 4, wherein the preset time range comprises a range between 5 and 10 nanoseconds before the signal output from the encoder transitions from low to high.

6. The low-dropout voltage system of claim 3 further comprising an acceleration switch coupled to the transistor circuitry, and wherein the acceleration switch is configured to decrease the bias current of the transistor circuitry after the mode changing switch increases the bias current.

7. The low-dropout voltage system of claim 6, wherein the acceleration switch comprises an acceleration switch coupled to the source of the PMOS transistor of the transistor circuitry, and wherein the acceleration switch is configured to pull up the voltage of the source voltage of the PMOS transistor of the transistor circuitry to decrease the bias current by coupling a power source to the gate of the PMOS transistor when the acceleration switch closes.

8. The low-dropout voltage system of claim 7, wherein the acceleration switch is configured to close when the signal output from the encoder transitions from high to low.

9. The low-dropout voltage system of claim 7, wherein the acceleration switch is configured to close about 10 nanoseconds after the signal output from encoder transitions from low to high.

10. A low-dropout voltage system comprising:

a current supply;

a decoupling capacitor coupled to the current supply; and a mode changing switch coupled to the current supply;

wherein, the current supply comprises a transistor circuitry configured to output a supply current;

the decoupling capacitor is configured to decouple and forward the supply current to an external load as a load current;

the mode changing switch is configured to adjust the supply current output of the current supply by adjusting a bias current of the transistor circuitry; and the load current is configured to be adjusted based on the adjustment of the supply current;

wherein, the low-dropout voltage system is coupled to an encoder, and the mode changing switch is configured to adjust the bias current of the transistor circuitry based on a signal output of the encoder;

wherein the mode changing switch comprises, a mode switch capacitor, a first end of which is coupled to the decoupling capacitor;

a first switch coupled to a second end of the mode switch capacitor and a ground; and a second switch coupled to the second end of the mode switch capacitor and the transistor circuitry, and wherein the first switch is configured to be closed to couple the second end of the mode switch capacitor to the ground and the second switch is configured to be open to decouple the second end of the mode switch capacitor from the transistor circuitry when the signal output from the encoder is low, the decoupling capacitor is configured to be coupled to the mode switch capacitor in parallel when the second end of the mode switch capacitor is coupled to the ground, and the supply current of the current supply when the second end of the mode switch capacitor is coupled to the ground and the decoupling capacitor is configured to be smaller than the supply current of the current supply when the second end of the mode switch capacitor is coupled to a source of a PMOS transistor of the transistor circuitry to pull down a voltage of the PMOS transistor source and increase the bias current of the transistor circuitry.

11. The low-dropout voltage system of claim 10, wherein, the first switch is configured to transition from an open to a close state and the second switch is configured to transition from a close to an open state when the signal output from the encoder transitions from high to low.

12. The low-dropout voltage system of claim 11, wherein, the first switch is configured to transition from the open to the close state and the second switch is configured to transition from the close to the open state about 10 nanoseconds after the signal output from the encoder transitions from low to high.

13. A low-dropout voltage system comprising:

a current supply;

a decoupling capacitor coupled to the current supply; and a mode changing switch coupled to the current supply;

wherein, the current supply comprises a transistor circuitry configured to output a supply current;

the decoupling capacitor is configured to decouple and forward the supply current to an external load as a load current;

the mode changing switch is configured to adjust the supply current output of the current supply by adjusting a bias current of the transistor circuitry; and the load current is configured to be adjusted based on the adjustment of the supply current;

wherein, the low-dropout voltage system is coupled to an encoder, and the mode changing switch is configured to adjust the bias current of the transistor circuitry based on a signal output of the encoder;

wherein the external load comprises a transceiver configured to drive an isolation barrier to transmit a signal representing the signal output of the encoder across the isolation barrier.

* * * * *